US008701607B2

(12) United States Patent
Allmond

(10) Patent No.: US 8,701,607 B2
(45) Date of Patent: Apr. 22, 2014

(54) SYSTEM AND METHOD FOR ENGINE VALVE LIFT STRATEGY

(75) Inventor: Christopher L. Allmond, Rochester Hills, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 69 days.

(21) Appl. No.: 13/217,847

(22) Filed: Aug. 25, 2011

(65) Prior Publication Data

US 2013/0047942 A1 Feb. 28, 2013

(51) Int. Cl.
*F01L 9/02* (2006.01)

(52) U.S. Cl.
USPC ..... 123/90.12; 123/90.15

(58) Field of Classification Search
USPC ..... 123/90.15, 90.12, 90.16
See application file for complete search history.

(56) References Cited

U.S. PATENT DOCUMENTS

| | | | | |
|---|---|---|---|---|
| 5,193,494 | A | 3/1993 | Sono et al. | |
| 5,503,120 | A | 4/1996 | Shirey et al. | |
| 5,537,976 | A | 7/1996 | Hu | |
| 5,690,065 | A | 11/1997 | Janse Van Vuuren | |
| 7,152,576 | B2 * | 12/2006 | Vanderpoel et al. | 123/321 |
| 7,334,550 | B2 * | 2/2008 | Jesel et al. | 123/90.6 |
| 2005/0126522 | A1 | 6/2005 | Ruggiero | |
| 2008/0149053 | A1 | 6/2008 | Harmon | |
| 2010/0326384 | A1 | 12/2010 | Vattaneo | |

FOREIGN PATENT DOCUMENTS

| | | | |
|---|---|---|---|
| EP | 1 245 799 | A2 | 10/2002 |
| EP | 1 852 593 | A1 | 11/2007 |
| EP | 1 936 132 | A1 | 6/2008 |
| EP | 2 184 452 | A1 | 5/2010 |
| EP | 2 204 566 | A1 | 7/2010 |
| EP | 2 261 471 | A1 | 12/2010 |
| WO | WO 91 08383 | A1 | 6/1991 |
| WO | WO 03 087544 | A2 | 10/2003 |
| WO | WO 2010 034643 | A1 | 4/2010 |

OTHER PUBLICATIONS

International Search Report dated Nov. 23, 2012 for International Application No. PCT/US2012/051846, International Filing Date Aug. 22, 2012.

Written Opinion dated Nov. 23, 2012 for International Application No. PCT/US2012/051846, International Filing Date Aug. 22, 2012.

* cited by examiner

*Primary Examiner* — Zelalem Eshete
(74) *Attorney, Agent, or Firm* — Ralph E Smith

(57) ABSTRACT

A system for controlling a valve in an engine is provided. The system includes a pump piston operably coupled to the valve. The valve is displaceable with electro-hydraulic variable valve actuation. The system also includes a cam lobe operably coupled to the pump piston. The cam lobe includes a profile configured so rotation of the cam lobe directs movement of the pump piston. The pump piston movement includes an increasingly accelerated first duration, followed by a decreasingly accelerated second duration, followed by an increasingly accelerated third duration, wherein when the valve is actuated the valve movement is in accordance with the configuration of the cam lobe.

20 Claims, 5 Drawing Sheets

SYSTEM AND METHOD FOR ENGINE VALVE LIFT STRATEGY

FIELD

The present disclosure relates to a system and method for controlling one or more valves in an engine having electro-hydraulic variable valve actuation technology.

BACKGROUND

Vehicles today are equipped with engines that use electro-hydraulic variable valve actuation technology that aids in controlling an engine's air intake. An engine designed with this variable valve actuation technology typically generates more horsepower and has reduced emissions and fuel consumption compared to an engine employing traditional valve actuation. The electro-hydraulic variable valve actuation technology provides increased performance and efficiency by optimizing the intake valves lifting schedules. Currently, valves in an engine employing this technology do not lift as rapidly as desired. The increased valve lifting time reduces the power and performance of the engine. Thus, there is a need to improve the lifting time of valves in engines employing electro-hydraulic variable valve actuation technology.

SUMMARY

The present disclosure provides a system for controlling a valve in an engine. The system includes a first pump piston operably coupled to a first valve. The first valve is displaceable with electro-hydraulic variable valve actuation. The system further includes a first cam lobe operably coupled to the first pump piston. The first cam lobe includes a profile configured so rotation of the first cam lobe directs movement of the first pump piston. The first pump piston movement includes an increasingly accelerated first duration, followed by a decreasingly accelerated second duration, followed by an increasingly accelerated third duration, wherein when the first valve is actuated the first valve movement is in accordance with the configuration of the first cam lobe.

The start of the first duration may not correspond to a closed position of the first valve when the first valve is actuated. The movement of the first pump piston may also include a decreasingly accelerated fourth duration following the third duration. Furthermore, the first duration of increased acceleration may be shorter than the third duration of increased acceleration.

Additionally, during the first duration of increased acceleration, the first pump piston may obtain a higher acceleration rate than obtained during the third duration of increased acceleration. Alternatively, during the first duration of increased acceleration, the first pump piston may obtain an acceleration rate twice that obtained during the third duration of increased acceleration. In one form, a finger follower may operably couple the first cam lobe to the first pump piston.

The system may further include a second valve and a second cam lobe operably coupled to a second pump piston. The second valve is displaceable with electro-hydraulic variable valve actuation. The second cam lobe includes a profile configured so rotation of the second cam lobe directs movement of the second pump piston, where the second pump piston movement includes an increasingly accelerated first duration, followed by a decreasingly accelerated second duration, followed by an increasingly accelerated third duration, wherein when the second valve is actuated the second valve movement is in accordance with the configuration of the second cam lobe.

In one embodiment, the first valve may be actuated to move and the first valve moves according to the first, second and third durations of first pump piston movement and the second valve is not actuated to move. Additionally, the first cam lobe profile and the second cam lobe profile may not have the same acceleration curve among the respective first, second and third acceleration durations.

The present disclosure also provides a method of controlling a valve in an engine. The method includes providing a first pump piston operably coupled to a first valve. The first valve is displaceable upon electro-hydraulic actuation. The method further includes rotating a first cam lobe operably coupled to the first pump piston to direct movement of the first pump piston, wherein the first cam lobe includes a profile configured so the first pump piston movement includes an increasingly accelerated first duration, followed by a decreasingly accelerated second duration, followed by an increasingly accelerated third duration, wherein when the first valve is actuated the first valve movement is in accordance with the configuration of the first cam lobe.

The method may further include providing a second pump piston operably coupled to a second valve. The second valve is displaceable with electro-hydraulic variable valve actuation. The method includes rotating a second cam lobe operably coupled to the second pump piston to direct movement of the second pump piston. The second cam lobe includes a profile configured so the second pump piston movement includes an increasingly accelerated first duration, followed by a decreasingly accelerated second duration, followed by an increasingly accelerated third duration, wherein when the second valve is actuated the second valve movement is in accordance with the configuration of the second cam lobe.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Disclosed herein are exemplary embodiments of a system for controlling movement of a valve in an engine where the valves are actuated between closed and open positions utilizing electro-hydraulic variable valve actuation technology. The system includes a pump piston operably coupled to a valve and a cam lobe operably coupled to the pump piston. The cam lobe includes a profile configured so when the cam lobe is rotated the pump piston is directed to move where the pump piston movement includes an increasingly accelerated first duration, followed by a decreasingly accelerated second duration, followed by an increasingly accelerated third duration. The cam lobe profile is configured so during the first acceleration duration, the pump piston obtains a higher rate of acceleration than obtained during the third duration of acceleration. The cam lobe profile is further configured so the first duration of increased acceleration is less than the third duration of increased acceleration.

In embodiments of the systems, when a valve is actuated to move, between a valve closed position and a valve full open position, the valve movement corresponds to the movement of the pump piston as configured by the cam lobe profile. By utilizing an embodiment of a cam lobe profile with the above accelerations relationship, the movement of a valve between a closed position and a valve full open position is controlled according to the cam lobe profile.

In the system embodiments, the start of the first acceleration duration of the pump piston may or may not correspond to a valve closed position when the valve is in an actuated position. In an exemplary embodiment of a multi-valve engine, one or more of the valves may be actuated to open according to the cam lobe profile while other valves may not be actuated to move. In an exemplary embodiment of a multi-valve engine, certain valves may be actuated to operate (open and close) in accordance with a pattern (e.g. timing, displacement) different compared to an operational pattern of one or more other valves.

In some multi-valve engine embodiments, a first valve may be actuated to move according to a first cam lobe profile, while a second valve may be actuated to move according to a second cam lobe profile, where the respective acceleration curves may not be exactly the same, start/stop times could different, peak acceleration values could be different, etc. This type of different cam lobe profile configuration may be employed for example to optimize a multi-valve valve performance for particular engine/vehicle goals, for example in a racing application.

Figure 1:
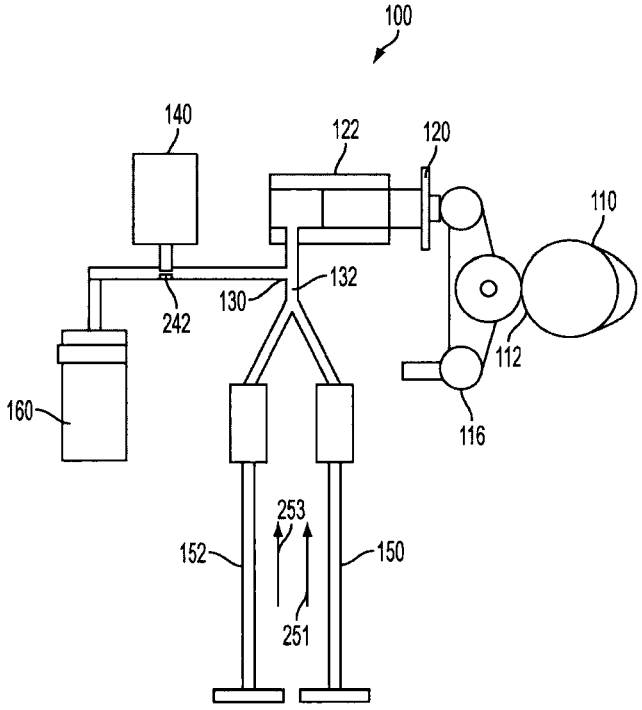
FIG. 1 illustrates a system for controlling valve movement in accordance with an exemplary embodiment of the present disclosure.

FIG. 1 illustrates a system 100 for controlling valve actuation in accordance with an exemplary embodiment of the present disclosure. System 100 is configured to aid in managing air intake in an internal combustion engine. System 100 includes cam lobe 110, cam lobe profile 112, finger follower 116, pump piston 120, pump piston cylinder 122, passageways 130, fluid 132, solenoid valve 140, solenoid valve port 242, intake valves 150, 152, and an accumulator 160.

Figure 2:
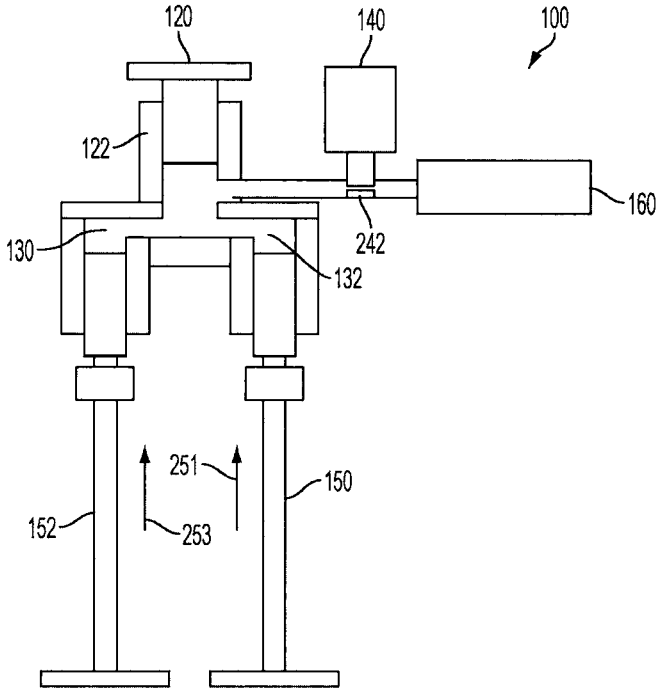
FIG. 2 illustrates a system for controlling valve movement in accordance with another exemplary embodiment of the present disclosure.

FIG. 2 illustrates a system 102 for controlling valve actuation in accordance with another exemplary embodiment of the present disclosure. System 102 is substantially similar to system 100, except system 102 utilizes a tappet (not shown) operably coupled to the cam lobe 110 to displaced the pump piston 120. In this embodiment, the tappet replaces the finger follower of system 100 of FIG. 1.

Referring to FIG. 1, cam lobe 110 is in contact with finger follower 116. Cam lobe profile 112 is the outer perimeter shape of cam lobe 110. As cam lobe 110 rotates, it applies a force to and displaces the finger follower 116. The force applied by cam lobe 110 to finger follower 116 varies according to cam lobe profile 112. Finger follower 116 transmits the force to the pump piston 120 to displace the pump piston in an oscillatory manner within the pump piston cylinder 122.

FIGS. 1 and 2 illustrate pump piston 120 as a cylindrical piston housed within pump piston cylinder 122. Pump piston 120 moves within pump piston cylinder 122 according to the force applied by finger follower 116. In the systems, the piston cylinder 122 is hydraulically connected to passageways 130. Passageways 130 contain fluid 132 hydraulically coupled to accumulator 160 by solenoid valve port 242. Solenoid valve 140 opens and closes at solenoid valve port 242 to respectively connect or disconnect accumulator 160 from passageways 130. In this embodiment, fluid 132 is engine oil. In another embodiment, the fluid may be some other type of fluid that has a higher bulk modulus or higher stiffness for a more desirable compressibility.

Passageways 130 are further hydraulically coupled to intake valves 150, 152. Intake valves 150, 152 move between lifted (i.e. open) and non-lifted (i.e. closed) positions in accordance with the configuration of the cam lobe profile 112. Valves 150, 152 are each maintained in the closed position by a corresponding valve spring that urges valves 150, 152 toward passageways 130. The direction of the force applied by the valve springs on valves 150, 152 is shown by arrows 251, 253 respectively.

Solenoid valve 140 is utilized to electrically actuate the valves 150, 152. The solenoid can be controlled to actuate a valve opening, closing, open/close duration, can be configured to sequence valve open lift in accordance with engine speed, timing, cam lobe profile and other engine and vehicle parameters.

In certain embodiments, a single actuator (e.g. solenoid valve) can be utilized with a cam lobe to direct movement of a pump piston and a single valve according to a profile of the cam lobe. In certain other embodiments, a single actuator is utilized with a cam lobe to direct movement of a pump piston and multiple valves according to a profile of the cam lobe, such as the embodiments shown in FIGS. 1 and 2.

Accumulator 160 is utilized to hold the fluid 132 displaced by the pump piston. For example, when solenoid valve 140 is closed, fluid 132 within passageways 130 does not flow into accumulator 160. Passageways 130 are configured with a defined volume and a corresponding volume of fluid 132 as determined at least, by the relative locations of valves 150, 152 and pump piston 120. When solenoid valve 140 is open, a portion of the fluid 132 flows into accumulator 160.

Figure 3:
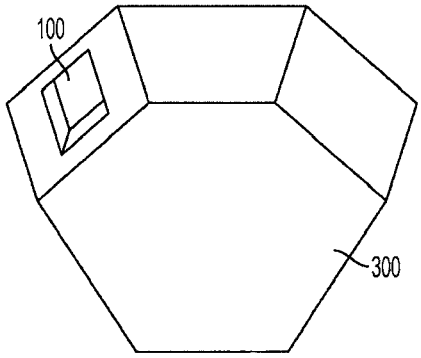
FIG. 3 is a schematic illustrating the system of FIG. 1 used with an internal combustion engine.

FIG. 3 illustrates system 100, for example, coupled to engine 300. During operation of engine 300, valves 150, 152 are displaced, lifted, and air and fuel can be injected into a cylinder within engine 300. To lift valves 150, 152, solenoid valve 140 is closed so that the volume of chamber 130 is defined by the relative locations of pump piston 120 and valves 150, 152. The displacement, lifting or opening, of valves 150, 152 occurs as related to the configuration of the cam lobe profile 112 and actuation of the solenoid valve 140. As cam lobe 110 rotates, it displaces and applies a force to finger follower 116 according to the cam lobe profile 112. Finger follower 116 translates the force to pump piston 120, displacing pump piston 120 and the fluid 132 within pump piston cylinder 122 and passageways 130. When pump piston 120 is displaced, pump piston 120 forces fluid 132 against solenoid valve 140 and valves 150, 152. The fluid applies a force to the valves that opposes the force of the valve spring of each of the valves. Valves 150, 152 initially do not lift because the force of their corresponding valve spring is greater than the force applied by fluid 132.

As pump piston 120 is further displaced along pump piston cylinder 122, the fluid 132 pressure increases inside passageways 130 and the fluid 132 applies a greater force to valves 150, 152. Eventually, the force of the fluid 132 on valves 150, 152 overcomes the force of the valve spring of each valve 150, 152. As the force of the valve springs are overcome, valves 150, 152 are lifted from the closed portion toward an open position. As valves 150, 152 lift, the volume of passageways 130 increases and the pressure begins to decrease.

After valves 150, 152 have lifted to their full open position, the force on pump piston 120 supplied by finger follower 116 depends on parameters such as engine speed. In one instance at a valve full-open position, the force on fluid 132 exerted by pump piston 120 is less than the force exerted on fluid 132 by valves 150, 152 on account of their corresponding valve spring. The valve springs thus begin to close valves 150, 152. As valves 150, 152 close, they exert a pressure on fluid 132 in passageways 130. Fluid 132 displaces pump piston 120 along pump piston cylinder 122 away from passageways 130. This process continues until valves 150, 152 are closed.

In some instances, solenoid valve 140 is electrically actuated open when pump piston 120 is displaced according to cam lobe profile 112. In these instances, the displacement of pump piston 120 moves fluid 132 into accumulator 160. As a result, the pressure within passageways 130 does not rise to a level sufficient to overcome the force of the valve springs of valves 150, 152 and valves 150, 152 are not lifted.

To lift valves 150, 152 quickly, it is desirable for the pressure within passageways 130 to be quickly raised to overcome the inertia of the valves' 150, 152 and the force of the spring valves. The time required to increase the pressure within passageways 130 is related to the rate of displacement or acceleration of the displacement of pump piston 120. However, it is desirable that the pressure in passageways 130 not exceed a predetermined level to prevent degradation to solenoid valve 140 and other areas within the system 100. For example, in one embodiment, solenoid valve 140 has a maximum pressure tolerance of 120 bar.

Figure 4:
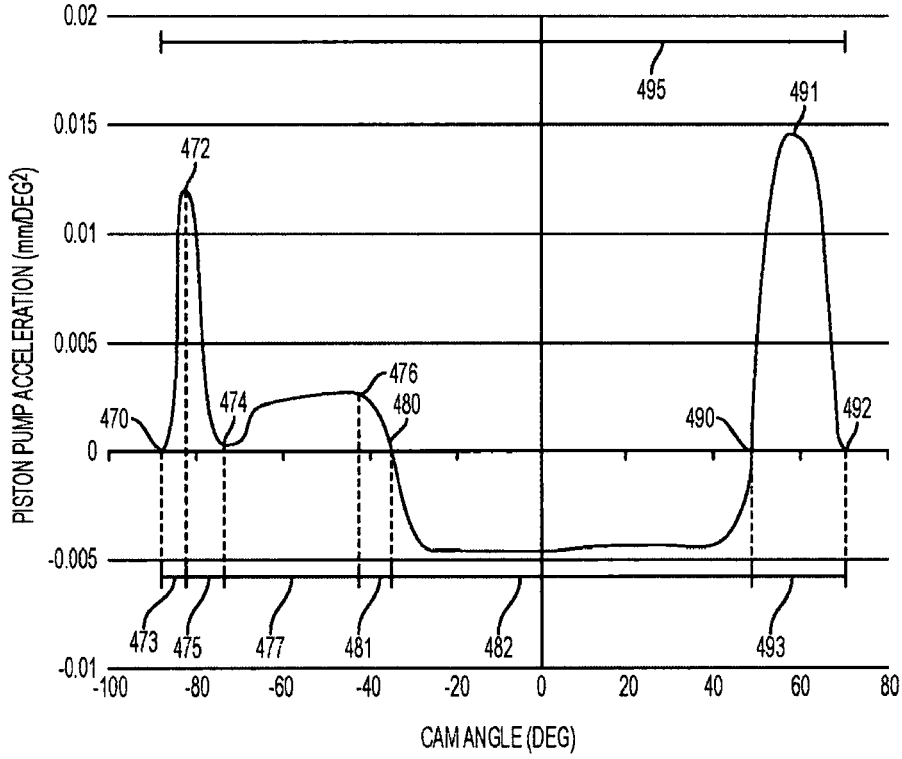
FIG. 4 illustrates an acceleration profile of a pump piston in accordance with an exemplary embodiment of the present disclosure.

FIG. 4 illustrates a graph showing an exemplary acceleration profile of pump piston 120. The graph has a vertical axis that shows the acceleration in mm per cam degrees$^2$ of pump piston 120. The horizontal axis shows the cam angle of cam lobe 110 in degrees. The graph illustrates the acceleration of pump piston 120 during one cycle of valves 150, 152, where valves 150, 152 move, are lifted, from a closed position to a valve full-open position and then move to the closed position again. This valve movement, defined as cycle duration 495, begins at beginning point 470 and ends at end point 492. Zero degree cam angle on the horizontal axis corresponds to the full-open valve position.

If solenoid valve 140 is closed, the displacement of pump piston 120 as depicted during duration 495 will open and close valves 150, 152. If, however, solenoid valve 140 is open, displacement of pump piston 120 as depicted during cycle duration 495 will not open or close valves 150, 152. It should be understood that the displacement, of the pump piston during cycle duration 495 is related to the cam lobe profile 112. The cam lobe profile 112 determines the displacement and the rate of displacement of pump piston 120.

Cycle duration 495 comprises various times of acceleration and deceleration of pump piston 120 as related to cam lobe angle. In one exemplary embodiment as shown, first acceleration duration 473 begins at beginning point 470 and ends at first apex 472. Pump piston 120 increasingly accelerates, i.e. the rate of acceleration increases, during first acceleration duration 473. The rapid acceleration of pump piston 120 during first acceleration duration 473 rapidly raises the pressure within passageways 130. The cam lobe profile is configured so the acceleration rate reached at the first apex 472 does not correspond to a system pressure that exceeds a predetermined system maximum allowable pressure. To further ensure that the pressure within passageways 130 does not exceed the predetermined system maximum allowable pressure, the cam lobe profile is configured so the rate of acceleration of pump piston 120 decreases from first apex 472 to trough 474, defining second acceleration duration 475. The second acceleration duration substantially follows the first acceleration duration. During second acceleration duration 475, pump piston 120 does not decelerate (i.e. decrease in velocity); rather, during second acceleration duration 475, pump piston 120 is accelerating (i.e. increasing in velocity), but at a decreasing rate of acceleration.

Pump piston 120 increasingly accelerates during third acceleration duration 477, defined as the duration between trough 474 and second apex 476. The third acceleration duration substantially follows the second acceleration duration. Sometime during first, second, or third acceleration durations 473, 475, 477, valves 150, 152 start to lift, and as a result, pump piston 120 is increasingly accelerated to maintain a high pressure in passageways 130 as valves 150, 152 are lifted. Between second apex 476 and first crossing 480, defining fourth acceleration duration 481, pump piston 120 decreasingly accelerates. During first acceleration duration 473, second acceleration duration 475, third acceleration duration 477, and fourth acceleration duration 481, valves 150, 152 are being lifted.

Between first crossing 480 and second crossing 490, defining fifth acceleration duration 482, pump piston 120 decelerates. During fifth acceleration duration 482, valves 150, 152 have been completely lifted and begin to close. Between second crossing 490 and end point 492, defining sixth acceleration duration 493, pump piston 120 is increasingly accelerated and reaches third apex 491. The increased acceleration during sixth acceleration duration 493 slows down valves 150, 152 prior to valves 150, 152 completely closing. This duration of increased acceleration prevents valves 150, 152 from degradation parts of system 100 or engine 300 as they close.

Figure 6:
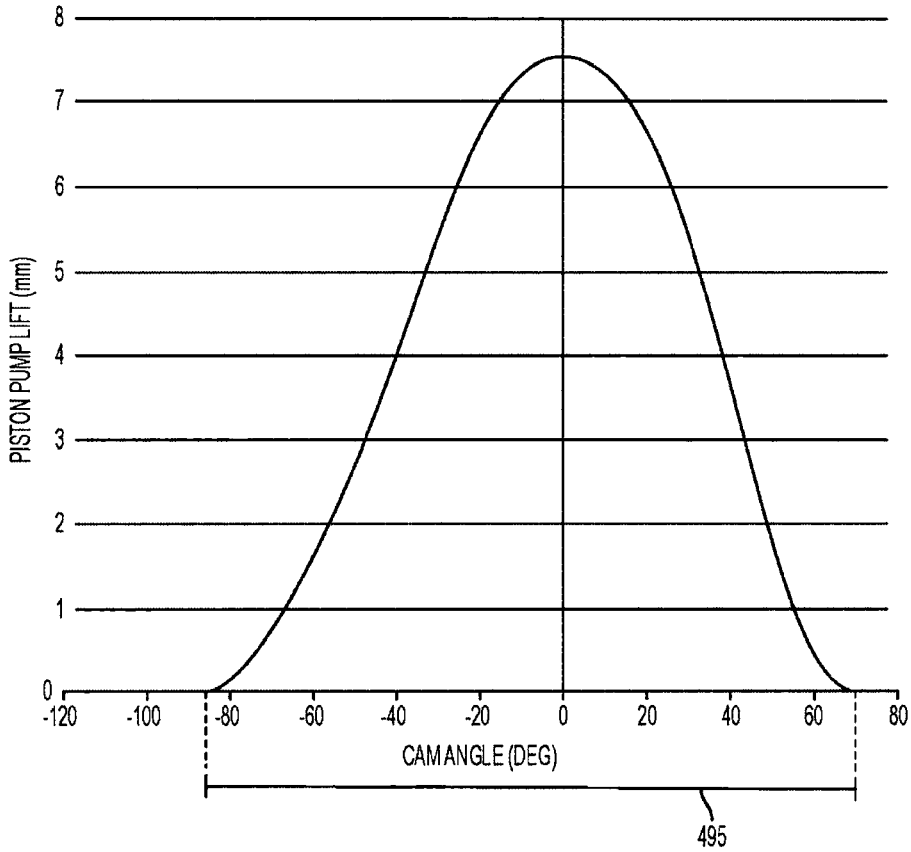
FIG. 6 illustrates a lift profile of the pump piston as related to FIGS. 4 and 5.

The above described acceleration profile of pump piston 120 lifts valves 150, 152 more quickly and accomplishes the lifting cycle of valves 150, 152 in less cam degrees than previous designs. This allows engine 300 to breathe better, thereby increasing the performance and power of engine 300. The valve displacement or distance that valves 150, 152 are lifted with respect to cam degrees is depicted in FIG. 6. During cycle duration 495, as described above, valves 150, 152 are lifted a distance of approximately seven and one-half mm from the closed position and then returned to the closed position.

It should be understood that the displacement and rate of displacement of pump piston 120, as depicted in FIG. 4, is according to cam lobe profile 112 of cam lobe 110. A change in cam lobe profile 112 will change the displacement and rate of displacement of pump piston 120. For example, as depicted in FIG. 4, pump piston 120 does not decelerate until after fourth acceleration duration 481. In other embodiments, however, cam lobe profile 112 may be designed so that pump piston 120 decelerates for some duration near trough 474. Further, in the embodiment illustrated in FIG. 4, the maximum rate of acceleration of pump piston 120 at first apex 472 during first acceleration duration 473 is more than twice the maximum acceleration of pump piston 120 at second apex 476 during third acceleration duration 477. In other embodiments, the maximum acceleration of pump piston 120 at first apex 472 may be less than twice the maximum acceleration of pump piston 120 at second apex 476.

Additionally, in an alternative exemplary embodiment, the start of the first acceleration duration of the pump piston does not correspond to a closed position of the valve as shown in FIG. 4. In that alternative embodiment, a second acceleration duration would follow the first acceleration duration and a third acceleration duration would follow the second acceleration duration. In that alternative embodiment, even though the first acceleration duration does not start at a valve closed position, the relationship between the first, second and third acceleration durations/curves of the pump piston may be substantially similar as describe above with respect to FIG. 4. In particular, the first acceleration duration would be higher than the third duration of acceleration and the second acceleration duration would have a decreasing acceleration compared to the first acceleration duration, even though the respective acceleration curves may not be exactly the same.

Figure 5:
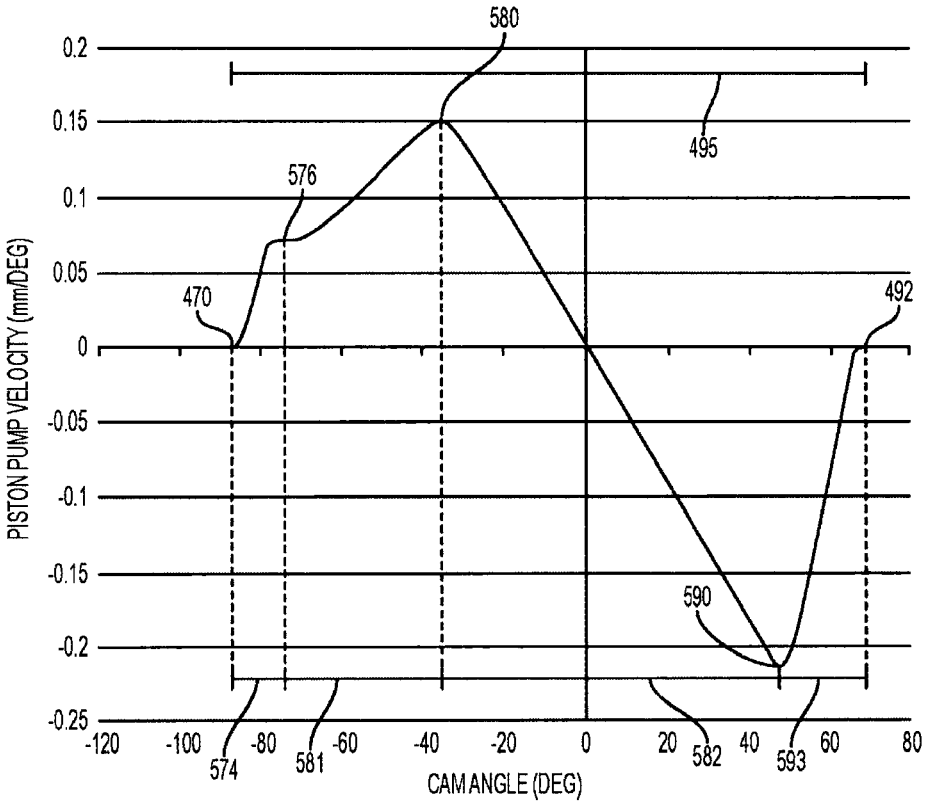
FIG. 5 illustrates a velocity profile of the pump piston as related to FIG. 4.

FIG. 5 illustrates a graph showing an exemplary velocity profile of pump piston 120 that corresponds to the acceleration profile of FIG. 4. The graph has an axis that shows the pump piston velocity in mm per cam degrees of pump piston 120. The other axis shows the cam angle of cam lobe 110 in degrees. The graph illustrates the velocity of pump piston 120 during cycle duration 495, which begins at beginning point 470 and ends at end point 492.

Cycle duration 495 comprises various durations of positive and negative velocity of pump piston 120 as measured in cam degrees. First velocity duration 574 begins at beginning point 470 and ends at first velocity apex 576. Pump piston's 120 velocity increases during first velocity duration 574. First velocity duration 574 corresponds with first and second acceleration durations 473 and 475.

Between first velocity apex 576 and second velocity apex 580, defined as second velocity duration 581, pump piston's 120 velocity continues to increase, however, at a slower rate than during first velocity duration 574. Second velocity duration 581 corresponds with third and fourth acceleration durations 477, 481. Between second velocity apex 580 and trough 590, defined as third velocity duration 582, the velocity of pump piston 120 decreases until pump piston 120 comes to rest as valves 150, 152 obtain their maximum lift. After coming to a rest, pump piston 120 has a negative velocity that increases as valves 150, 152 are closed. Third velocity duration 582 corresponds to fifth acceleration duration 482. Between trough 590 and end point 492, defined as fourth velocity duration 593, the negative velocity of pump piston 120 decreases until pump piston comes to rest again and valves 150, 152 are closed at end point 492. Fourth velocity duration 593 corresponds to sixth acceleration duration 493.

What is claimed is:

1. A system for controlling a valve in an engine, the system comprising:

a first pump piston operably coupled to a first valve, the first valve being displaceable with electro-hydraulic variable valve actuation; and a first cam lobe operably coupled to the first pump piston, the first cam lobe having a profile configured so rotation of the first cam lobe directs movement of the first pump piston, where the first pump piston movement includes an increasingly accelerated first duration, followed by a decreasingly accelerated second duration, followed by an increasingly accelerated third duration, wherein when the first valve is actuated the first valve movement is in accordance with the configuration of the first cam lobe.

2. The system of claim 1, wherein the start of the first duration does not correspond to a closed position of the first valve when the first valve is actuated.

3. The system of claim 1, wherein the movement of the first pump piston includes a decreasingly accelerated fourth duration following the third duration.

4. The system of claim 1, wherein the first duration of increased acceleration is shorter than the third duration of increased acceleration.

5. The system of claim 1, wherein during the first duration of increased acceleration, the first pump piston obtains a higher acceleration rate than obtained during the third duration of increased acceleration.

6. The system of claim 1, wherein during the first duration of increased acceleration, the first pump piston obtains an acceleration rate twice that obtained during the third duration of increased acceleration.

7. The system of claim 1, wherein a finger follower operably couples the first cam lobe to the first pump piston.

8. The system of claim 1, further comprising a second valve and a second cam lobe operably coupled to a second pump piston, the second valve being displaceable with electro-hydraulic variable valve actuation, the second cam lobe includes a profile configured so rotation of the second cam lobe directs movement of the second pump piston, where the second pump piston movement includes an increasingly accelerated first duration, followed by a decreasingly accelerated second duration, followed by an increasingly accelerated third duration, wherein when the second valve is actuated the second valve movement is in accordance with the configuration of the second cam lobe.

9. The system of claim 8, wherein the first valve is actuated to move and the first valve moves according to the first, second and third durations of first pump piston movement and the second valve is not actuated to move.

10. The system of claim 8, wherein the first cam lobe profile and the second cam lobe profile do not have the same acceleration curve among the respective first, second and third acceleration durations.

11. A method of controlling a valve in an engine, the method comprising:

providing a first pump piston operably coupled to a first valve, the first valve being displaceable upon electro-hydraulic actuation; and rotating a first cam lobe operably coupled to the first pump piston to direct movement of the first pump piston, wherein the first cam lobe includes a profile configured so the first pump piston movement includes an increasingly accelerated first duration, followed by a decreasingly accelerated second duration, followed by an increasingly accelerated third duration, wherein when the first valve is actuated the first valve movement is in accordance with the configuration of the first cam lobe.

12. The method of claim 11, wherein the start of the first duration does not correspond to a closed position of the first valve when the first valve is actuated.

13. The method of claim 11, wherein the movement of the first pump piston includes a decreasingly accelerated fourth duration following the third duration.

14. The method of claim 11, wherein the first duration of increased acceleration is shorter than the third duration of increased acceleration.

15. The method of claim 11, wherein during the first duration of increased acceleration, the first pump piston obtains a higher acceleration rate than obtained during the third duration of increased acceleration.

16. The method of claim 11, wherein during the first duration of increased acceleration, the first pump piston obtains an acceleration rate twice that obtained during the third duration of increased acceleration.

17. The method of claim 11, wherein a finger follower operably couples the first cam lobe to the first pump piston.

18. The method of claim 11, further comprising providing a second pump piston operably coupled to a second valve, the second valve being displaceable with electro-hydraulic variable valve actuation; and rotating a second cam lobe operably coupled to the second pump piston to direct movement of the second pump piston, wherein the second cam lobe includes a profile configured so the second pump piston movement includes an increasingly accelerated first duration, followed by a decreasingly accelerated second duration, followed by an increasingly accelerated third duration, wherein when the second valve is actuated the second valve movement is in accordance with the configuration of the second cam lobe.

19. The method of claim 18, wherein the first valve is actuated to move and the first valve moves according to the first, second and third durations of first pump piston movement and the second valve is not actuated to move.

20. The method of claim 18, wherein the first cam lobe profile and the second cam lobe profile do not have the same acceleration curve among the respective first, second and third acceleration durations.

* * * * *